United States Patent [19]

Jones

[11] 4,294,203

[45] Oct. 13, 1981

[54] INTERNAL COMBUSTION ENGINE WITH INTEGRAL UPPER CYLINDER SECTION AND HEAD

[75] Inventor: Philip E. Jones, Columbus, Ind.

[73] Assignee: Cummins Engine Company, Inc., Columbus, Ind.

[21] Appl. No.: 74,065

[22] Filed: Sep. 10, 1979

[51] Int. Cl.[3] ..... F02F 7/00; F02F 1/10; F02B 75/18

[52] U.S. Cl. ..... 123/195 R; 123/41.74; 123/41.84; 123/41.83; 123/193 C; 123/193 CH

[58] Field of Search ..... 123/41.84, 41.82, 193 C, 123/193 CH, 195 R; 92/171

[56] References Cited

U.S. PATENT DOCUMENTS

| | | | |
|---|---|---|---|
| 1,410,752 | 3/1922 | Hart . | |
| 1,488,272 | 3/1924 | Milner | 92/171 |
| 1,607,265 | 11/1926 | Leipert | 123/193 CH |
| 1,665,192 | 4/1928 | Spence | 123/41.84 |
| 1,716,256 | 6/1929 | Birkigt . | |
| 2,125,106 | 7/1938 | Gehret . | |
| 2,170,443 | 8/1939 | Barbarou . | |
| 3,046,953 | 7/1962 | Dolza . | |
| 3,077,187 | 2/1963 | Stancliff | 123/41.84 |
| 3,315,573 | 4/1967 | Castelet | 92/171 |
| 3,463,056 | 8/1969 | Moore et al. . | |
| 3,521,613 | 7/1970 | Celli | 123/41.81 |
| 3,568,573 | 3/1971 | Bailey | 92/171 |
| 3,674,000 | 7/1972 | Reisacher et al. . | |
| 3,691,914 | 9/1972 | Reisacher et al. . | |
| 3,942,807 | 3/1976 | Dinger . | |
| 4,237,847 | 12/1980 | Baugh et al. . | |
| 4,244,330 | 1/1981 | Baugh et al. . | |

FOREIGN PATENT DOCUMENTS

| | | | |
|---|---|---|---|
| 1116882 | 12/1954 | France | 92/171 |
| 126330 | of 1919 | United Kingdom . | |
| 522741 | 7/1940 | United Kingdom . | |
| 1479139 | 6/1974 | United Kingdom . | |

*Primary Examiner*—Ronald B. Cox

*Attorney, Agent, or Firm*—Sixbey, Friedman & Leedom

[57] ABSTRACT

An engine structural assembly is disclosed including an integral head and upper cylinder section assembly for use in combination with an integral crankcase and lower cylinder section assembly wherein the upper and lower assemblies are formed to receive a wet cylinder liner which is adapted to be directly contacted by engine coolant over only the exterior surfaces of the liner which are received within the upper assembly. For purposes of forming a coolant cavity around the portion of the liner received in the upper assembly, a coolant seal is provided between the liner and the upper assembly adjacent the joinder zone between the upper and lower assemblies. In one embodiment the liner includes a mid stop located adjacent the upper and lower assemblies for holding the mid section of the liner in a fixed axial position and for applying an axial compressive force to the liner along the portion of the liner received within the upper assembly. Greater efficiency, lower weight, easier maintenance and reduced manufacturing costs are achieved by limiting the total axial length of the liner received in the upper assembly to no more than 40%, and preferably approximately 30%, of the total axial length of the liner.

21 Claims, 6 Drawing Figures

INTERNAL COMBUSTION ENGINE WITH INTEGRAL UPPER CYLINDER SECTION AND HEAD

TECHNICAL FIELD

This invention is concerned with the technology of internal combustion engines including one piece integral head and cylinder section assembly designed to receive cylinder liners.

BACKGROUND ART

The development of a practical, lightweight internal combustion engine of the compression ignition type has been a goal of engine designers for many decades. Great strides have been made toward this goal. However, no engine design has heretofore been disclosed which is sufficiently superior, in a practical sense, to displace the spark ignition internal combustion engine as the preferred choice in high volume applications such as for powering automobiles. In an attempt to provide the increased strength required in a compression ignition engine without adding significantly to the cost and weight of the engine, it has been proposed to form the engine head and cylinder block as a one-piece integral unit such as illustrated in U.S. Pat. Nos. 3,674,000 and 3,691,914. Engine designs of the type illustrated in these patents obviously have the desirable effect of eliminating the requirement for a high temperature, high pressure head gasket seal. In addition to reducing cost, elimination of the head gasket also simplifies the head design by eliminating the need for head bolts and corresponding head bolt bosses.

While achieving the advantages noted above, previously disclosed integral head and cylinder block designs have suffered from several significant drawbacks. For example, it has generally been considered good practice in a liquid cooled engine to extend the cooling jacket over substantially the entire axial length of the cylinder cavity. When formed to accommodate this requirement, an integral head and cylinder block for a liquid cooled engine becomes quite heavy and bulky. Obviously, significant assembly and maintenance problems result when such a substantial portion of the entire engine assembly is formed as a single unit. Moreover, the depth of the cylinder cavities imposes manufacturing difficulties particularly with respect to forming the valve seats at the base of each cavity. Integral head and block units are also susceptible to cracks at the juncture of the cylinder head bottom and the inner wall of the cylinder cavity by reason of the high combustion pressure and thermal stresses existant at this location as discussed in U.S. Pat. No. 3,691,914. Further problems result from the use of substantially full length liquid cooling jackets since such jackets require a relatively complicated, high volume coolant system and add to the overall size and weight of the integral head and block.

Still another complication which has tended to discourage the use of integral head and block designs has been the difficulty associated with the use of removable liners within the cylinder cavities. It has long been recognized that removable cylinder liners provide significant cost and performance advantages in internal combustion engines by permitting, for example, the engine to be overhauled simply by replacement of the cylinder liners without requiring the use of oversized pistons or rings. Removable liners are generally categorized as either "dry" or "wet". A "dry" liner is one from which the heat of combustion is removed without bringing the liquid engine coolant into direct contact with the liner (illustrated, for example, in U.S. Pat. Nos. 1,488,272 and 3,521,613). A "wet" liner, on the other hand, is one from which heat is removed by direct contact with the coolant. See for example U.S. Pat. No. 3,942,807. Wet liners are considered to be more desirable since the cylinder block can be simplified in design and since cooling efficiency is increased by direct contact of the coolant with the liner. However, wet liners present additional sealing problems over dry liners since wet liners must be sealed against coolant as well as combustion gas leakage. When employed in combination with an integral head and cylinder block, wet liners create further coolant sealing problems requiring close tolerances especially in designs employing substantially full length coolant jackets such as illustrated in U.S. Pat. Nos. 1,716,256, 2,170,443 and 2,125,106 and in British Patent No. 522,741 accepted June 26, 1940.

Cylinder liners may be further categorized in accordance with the manner by which the liner is retained within the cylinder cavity. By far the most common approach in conventional two piece head and cylinder engine designs is to provide a top flange adopted to be compressively held between the top of the engine block and the removable head such as disclosed in U.S. Pat. No. 3,463,056. Where the head and block are formed integrally, the conventional retaining flange must obviously be moved to a different point on the exterior of the cylinder liner such as illustrated in U.S. Pat. No. 1,488,272, wherein an integral head and partial cylinder block is disclosed in combination with a dry liner having a retaining flange positioned at the juncture between the upper and lower sections of the block. This type of liner is known as a "midstop" liner. Another approach has been to remove the flange altogether and trap the liner between its ends as illustrated in U.S. Pat. No. 3,046,953. Liners may also be attached at their lower ends with sufficient axial clearance being provided at their upper ends to permit axial thermal expansion without imposing compressive stress on the liner such as illustrated in U.S. Pat. No. 1,410,752. Still another approach has been to abandon the conventional retaining flange in favor of a screw threaded connection between the liner and engine block as illustrated in U.S. Pat. No. 1,716,256. The problems associated with the machining of screw threads within the upper portion of each cylinder cavity of an integral head and substantially full length cylinder block as shown in this patent are readily apparent.

Since wet liners are normally employed in circumstances where a full length coolant jacket is used, it is unusual for the retaining flange of a wet liner to be positioned intermediate the ends of the liner. Such a concept is disclosed, however, in U.S. Pat. No. 3,568,573 wherein the liner is supported by a shoulder located approximately at the midsection of the liner while the coolant jacket extends downwardly (toward the crankcase) of this shoulder thereby forming a "dry" liner portion downwardly of the shoulder and a "wet" liner portion upwardly of the shoulder. French Pat. No. 1,116,882 discloses a similar arrangement. In those few known engine designs employing a midstop "wet" liner combined with a coolant system in which all heat transfer with the coolant occurs upwardly of the midstop, such as illustrated in U.S. Pat. Nos. 1,607,265 and 3,315,573, the midstop is positioned within the vicinity of the lower limit of travel of the top of the piston. Thus, the midstop is positioned no closer to the outer end of the liner than approximately 50 percent of the total axial length of the liner.

In modern turbocharged engines, it is considered highly desirable to maintain the maximum possible amount of usable energy in the exhaust gases for use in operating the turbocharger. In spite of this recognition, the axial length of the coolant jackets in wet linered turbocharged engines has not heretofore been reduced below 50% of the total axial length of the liner due to the apparent belief that excessive engine temperatures would result. Prior limited cooling concepts have been suggested, such as disclosed in British Pat. No. 1,479,139, but such concepts have not been thought to be applicable to wet linered turbocharged engines.

In addition to the difficulties associated with the use of integral head and block designs and with the use of wet liners, internal combustion engines particularly of the compression ignition type often produce excessive noise unless costly sound baffling techniques are employed. Heretofore, no integral head and block design employing a wet liner has been disclosed which is characterized simultaneously by low operational noise generation.

DISCLOSURE OF INVENTION

The purpose of this invention is to overcome the deficiencies of the prior art and in particular to provide a practical, lightweight internal combustion engine.

A more particular object of this invention is to provide an internal combustion engine assembly including a one piece, integral head and partial upper cylinder section assembly incorporating the advantages of prior integral designs while eliminating the various drawbacks as discussed above.

A still more specific object of this invention is to provide an integral head and upper cylinder section assembly for an internal combustion engine which is sufficiently small in size and light in weight as to avoid assembly and/or maintenance problems.

It is yet another object of this invention to provide an integral head and upper cylinder section assembly for an internal combustion engine wherein significant machining difficulties have been avoided by limiting the total axial length of the cylinder cavities actually contained within the integral head and upper cylinder section assembly.

It is still another object of this invention to provide an internal combustion engine assembly including a cooling system having coolant flow passages which extend over a limited portion of the total axial length of each cylinder cavity.

Still another object of this invention is to provide an engine structural assembly for an internal combustion engine, such as a compression ignition engine, including a one piece, integral head and upper cylinder section assembly containing a recess shaped to form one portion of a cylinder cavity and an integral crankcase and lower cylinder section assembly containing the remaining portion of the cylinder cavity further combined with a wet liner including a coolant seal disposed adjacent the zone of joinder between the upper and lower cylinder section assemblies.

A further object of this invention is to provide an engine structural assembly for an internal combustion engine, such as a compression ignition engine, including a one piece, integral head and upper cylinder section assembly containing a recess shaped to form one portion of a cylinder cavity and an integral crankcase and lower cylinder section assembly containing the remaining portion of the cylinder cavity further combined with a wet liner including a radial flange for positioning the liner within the cylinder cavity wherein the radial flange is positioned adjacent the juncture of the upper and lower cylinder section assemblies.

Still another object of this invention is to provide an engine structural assembly including an integral head and upper cylinder section assembly for receiving a midstop wet liner in which the midstop is positioned from the upper end of the liner by a distance which is less than 75 percent of the total axial distance of the lowermost limit of travel of the upper surface of the piston as measured from the upper end of the liner.

Still another object of this invention is to provide a liner for the cylinder cavity of an integral head and upper cylinder section assembly wherein the liner includes a radial flange positioned less than 40 percent of the total axial length of the liner from the upper end thereof. The assembly is further provided with a coolant cavity forming means located within the integral head and upper cylinder section assembly for directing cooling fluid through the engine structural assembly along a coolant path shaped to bring the coolant into direct contact with the liner only along that portion of the liner received within the integral head and upper cylinder section assembly.

Still another object of this invention is to provide an integral head and upper cylinder section assembly formed to receive in one embodiment a midstop wet liner by means of a press fit between the liner and the upper cylinder section assembly.

It is yet another object of this invention to provide a lighter weight engine assembly including an integral head and upper cylinder section assembly arranged to receive one portion of a liner wherein the liner, upper cylinder section and head are formed of cast iron combined with an integral crankshaft and lower cylinder section formed of light weight material and shaped to receive the remaining portion of the liner.

It is yet another object of this invention to provide an engine structural assembly designed to reduce total noise generation during engine operation. In particular, the subject invention includes an engine structural design arranged to reduce the propagation of vibrational energy along the side walls of the engine block.

It is a still more specific object of this invention to provide an engine structural assembly for receiving a cylinder liner wherein greater support is supplied to the cylinder liner along its mid section to assist in controlling the deleterious effects of coolant cavitation erosion.

Other objects of this invention include the provision of an engine structural assembly which allows for reduction in the overall coolant system capacity and which produces an increase in the amount of energy supplied to the exhaust gases for use in the engine turbocharger.

Still other and more specific objects of this invention may be appreciated by consideration of the following Brief Description of Drawings and the following Description of the Best Mode for Carrying Out the Invention.

BEST MODE OF CARRYING OUT THE INVENTION

Figure 1:
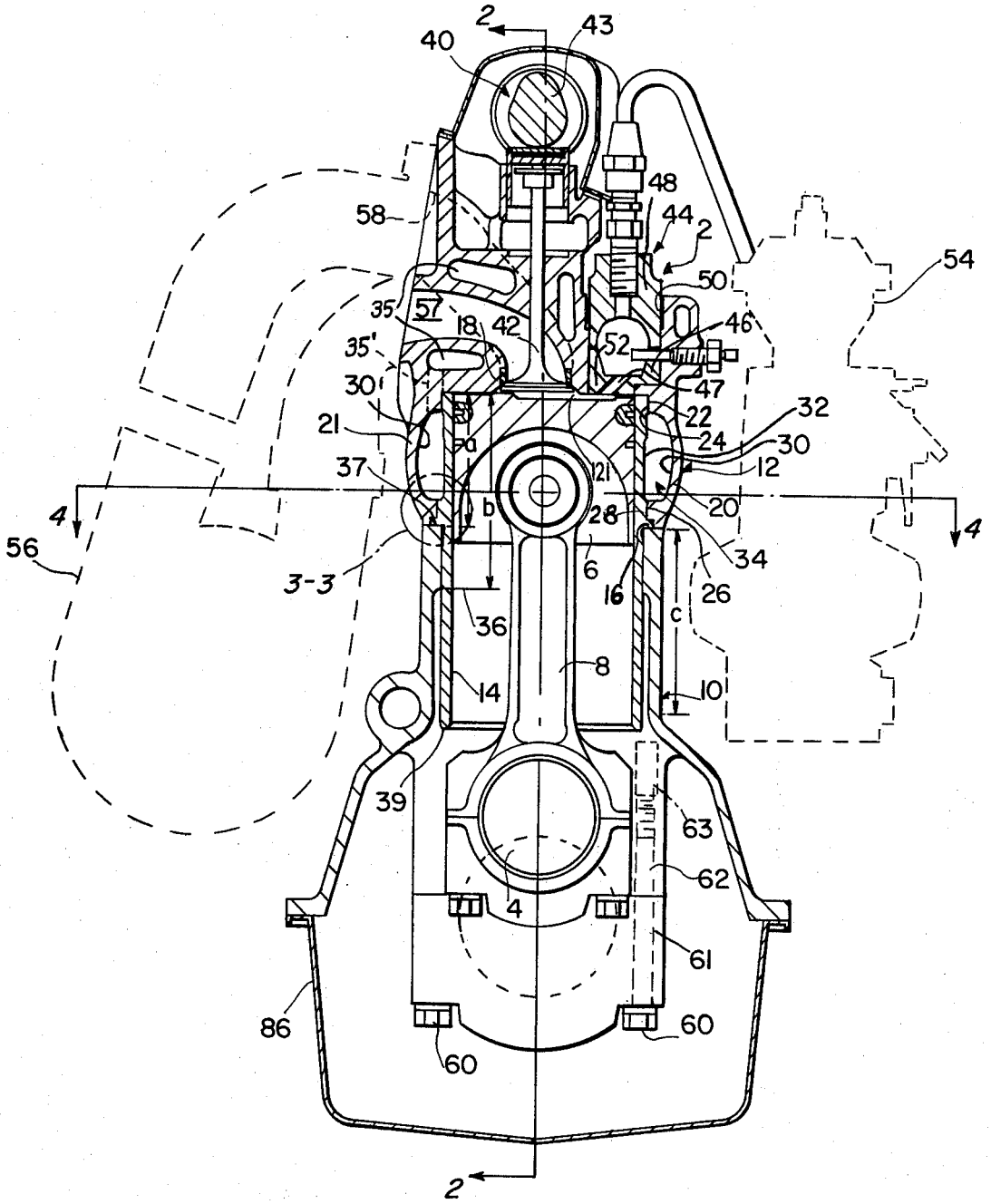
FIG. 1 is a vertical transverse cross-sectional view of an internal combustion engine structural assembly designed in accordance with this invention.

An engine structural assembly 2 designed in accordance with the subject invention is illustrated in FIG. 1. Assembly 2 is designed to receive a crankshaft 4 connected with one or more reciprocating pistons 6 (only one being illustrated in FIG. 1) by means of connecting rods 8. For purposes of this description, the word "upper" will refer to a direction away from the crankshaft 4 whereas the word "lower" will refer to an opposite direction toward the crankshaft 4.

Piston 6 is disposed within a cylinder cavity contained within an integral crankcase and lower cylinder section assembly 10 referred to hereinafter as lower assembly 10 and a one piece integral head and upper cylinder section assembly 12 referred to hereinafter as upper assembly 12. A cylinder liner 14 for guiding the reciprocating movement of piston 6 is disposed within the cylinder cavity formed within lower assembly 10 and upper assembly 12. Liner 14 may be of the removable type, or may be attached permanently to either the upper or lower assemblies. Liner 14 is provided with a radial flange 16 positioned intermediate the liner ends. The position of radial flange 16 is an important feature of one embodiment of this invention and will also be discussed in greater detail below. The purpose of radial flange 16 is to form a stop means for retaining liner 14 in a desired axial position within the cylinder cavity.

The upper portion of upper assembly 12 includes a combustion chamber forming wall 18 integral with the upper assembly 12 and extending across the upper end of removable liner 14 when the liner is positioned within the cylinder cavity.

As is apparent from FIG. 1, lower assembly 10 contains that portion of the cylinder cavity which receives the lower portion of liner 14 extending downwardly from radial flange 16 toward the crankshaft 4 when the liner 16 is positioned within the engine structural assembly 2. The one piece integral upper assembly 12 contains a recess shaped to form that portion of the cylinder cavity which receives the upper portion of the liner 14 extending upwardly from radial flange 16 away from the engine crankshaft 4.

Upper assembly 12 includes a pair of side walls 20 and 21 extending downwardly from the combustion chamber forming wall 18 toward the engine crankshaft 4. A first annular circumferential surface 22, formed on the inside of each cylinder cavity, depends from wall 18 and is adapted to form a circumferential fit with a mating circumferential surface 24 formed on the radially exterior surface of liner 14 adjacent the uppermost end thereof. The undistorted diameter of circumferential surface 22 is slightly less than the diameter of corresponding surface 24 formed on liner 14. In this way, insertion of liner 14 into the liner receiving cylinder cavity defined in part by side walls 20 and 21 causes an interference fit between surfaces 22 and 24. This interference fit will normally be sufficient to seal off the combustion gases resulting from fuel ignition within the cylinder cavity. The axial length between the lower radial surface 37 of radial flange 16 or equivalent stop forming shoulder and the upper end of liner 14 is normally slightly less than the axial length of the liner receiving cylinder cavity formed in upper assembly 12. In this manner, a small clearance exists between the outer end of liner 14 and the combustion chamber forming wall 18 to allow for thermally induced axial expansion. Should the interference fit between surfaces 22 and 24 prove inadequate to insure against combustion gas leakage, a small combustion gasket may be inserted between the upper end of liner 14 and combustion chamber forming wall 18. Alternately, the axial length between the lower radial surface 37 of radial flange 16 and the upper end of liner 14 may be increased to cause the upper end to be brought into contact with combustion wall 18 when upper and lower assemblies 10 and 12 are assembled together. When this later design feature is employed, the upper portion of liner 14 received in upper assembly 12 is compressed to assure a gas tight seal between the upper end of liner 14 and combustion wall 18. Still another variation for connecting liner 14 with upper assembly 12 would be to replace the interference fit with a threaded connection. Each cylinder cavity further includes a second annular circumferential surface 26 arranged to form an interference fit with a corresponding circumferential surface 28 on liner 14 formed just above radial flange 16. The undistorted diameter of second annular circumferential surface 26 is slightly less than the undistorted diameter of surface 28 to cause an interference fit when liner 14 is pressed into the liner receiving cavity of the upper assembly 12.

Side walls 20 and 21 further include an inside recess 30 between the first circumferential surface 22 and the second circumferential surface 26. The surface of the recess 30 is spaced radially from the corresponding outer surface 32 of the liner 14 for at least a portion of the circumference of the liner thereby defining a coolant flow cavity 34. Other coolant flow passages 35, formed in the upper assembly 12, communicate with cavity 34 by means of flow passages 35′ illustrated in dashed lines. As is apparent in FIG. 1, this flow cavity allows direct contact of the engine coolant with the outer surface of the liner 14 only along the portion of the liner disposed entirely within the upper assembly 12. In the preferred embodiment, the axial length of recess 30 is approximately 30 percent of the total axial length of liner 14. As illustrated in FIG. 1, the lower limit of travel of the upper surface of piston 6 occurs at point 36 spaced a distance b from the upper end of liner 14. The lowermost radial surface 37 of radial flange 16 is spaced from the uppermost end of liner 14 by a distance a. An important feature of this invention is that distance a comprises no more than approximately 75 percent of distance b. This configuration of the stop of a wet liner is totally contrary to the configuration normally thought to be necessary in order to obtain adequate cooling of the cylinder liner of an internal combustion engine. A more general application of this principle is discussed in detail in the commonly assigned co-pending applications Ser. No. 22,647, filed Mar. 21, 1979, entitled COMPOSITE ENGINE BLOCK HAVING HIGH STRENGTH TO WEIGHT RATIO, now U.S. Pat. No. 4,237,847 and Ser. No. 959,702, filed Nov. 13, 1978, entitled ENGINE CYLINDER LINER HAVING A MIDSTOP now U.S. Pat. No. 4,244,300. The disclosure of both of these co-pending applications is incorporated herein by reference.

In order to provide sufficient support for piston 6, it is apparent that liner 14 must extend downwardly from point 36 by an amount approximately equal to the axial length of piston 6. Accordingly, in this embodiment, flange 16 is positioned approximately 40 percent or less of the total axial length of liner 14 below the uppermost end thereof.

A major advantage of the design illustrated in FIG. 1 is that the lower assembly 10 may be formed of light metal alloy such as an aluminum alloy with the effect that the overall weight of the engine structural assembly is considerably reduced below that of a more conventionally designed engine having the same displacement. In particular, lower assembly 10 may form that portion of an engine assembly normally referred to as the crankcase and in addition may extend upwardly from the crankshaft along the cylinder cavity by a distance c normally formed by the conventional cylinder block. The difference in coefficient of expansion between that of the cylinder liner 14 and that of the aluminum alloy of the lower assembly 10 has no effect upon long range engine performance and reliability because the portion of liner 14 received within the lower assembly 10 is unconstrained in the axial direction and may thus readily expand and contact within the portion of the cylinder cavity contained within lower assembly 10. It is within the scope of this invention to form the liner stop (i.e. flange 16 or its equivalent) at a lower point along the axial length of liner 14 and to form a correspondingly positioned flange engaging ledge on the interior surface of the portion of the cylinder cavity contained in lower assembly 10. In fact liner 14 may be held in place by means of a liner engaging ledge positioned to engage the lowermost end 39 of liner 14 thereby forming a "bottom stop" liner. Regardless of the axial position of the liner stop, it is an important characteristic of this invention that a coolant seal would still be formed adjacent the zone along which upper and lower assemblies 10 and 12 are joined to insure that engine coolant contacts only the portion of the exterior surface of liner 14 which is received in upper assembly 12. It should be noted that the upper and lower assemblies may not actually touch in which case the joinder zone would be the portion of the overall engine structure at which the upper and lower assemblies come the closest to one another.

By forming the coolant flow cavity 34 over an axial distance considerably less than thought heretofore to be required for adequate cooling, the coolant seal adjacent the zone of joinder of assemblies 10 and 12 may be moved upwardly along the axial length of the liner 14 to thereby permit the portion of lower assembly 10 extending upwardly along distance c to be maximized, thereby maximizing the weight reducing capacity of the aluminum alloy. This configuration of the engine in no way compromises the high strength and superior temperature cycling characteristics of the engine since it has been found that adequate cooling can be obtained by the short axial length coolant cavity 34 illustrated in FIG. 1.

The engine assembly of FIG. 1 is illustrated as employing an overhead cam arrangement 40 for operating the inlet valve (not illustrated) and exhaust valve 42 for each piston cylinder of the internal combustion engine. The bearing supports, not illustrated, for cam shaft 43 may be cast integrally with the upper assembly 12 or may be separately formed and joined to the upper assembly 12 by connecting bolts. Upper assembly 12 may also be provided with an auxiliary combustion chamber 44 for each cylinder wherein chamber 44 is formed in two halves. The lower half 46 has an outlet 47 angularly arranged to inject the precombustion products into the main combustion chamber 121. A second half 48 may be screw threaded into a recess 50 formed in upper assembly 12 or may be held in position by a clamp (not illustrated). Note that the lower end of half 46 includes an eccentric projection 52 for insuring proper orientation of the lower half 46 during assembly of the auxiliary combustion chamber.

Fuel is supplied to the auxiliary combustion chamber via a fuel pump assembly 54 illustrated in dashed lines. An exhaust driven turbocharger 56, illustrated in dashed lines, is arranged to provide air to an air inlet passage 58 (illustrated in dashed lines) for each cylinder cavity formed in the engine structural assembly. Exhaust gases from the respective combustion chambers are provided to turbocharger 56 through an exhaust passage 57. Both the inlet passage and exhaust passage for each cylinder cavity may be made considerably shorter than in engine designs employing a conventional head. Such reduction can lead to greater efficiency, especially in a turbocharged engine, since the shorter exhaust gas passage reduces flow losses thereby retaining more energy in the exhaust gases for use by the engine turbine.

Elimination of the conventional joint between the head and cylinder block at the point of highest combustion gas pressure also eliminates the critical need for extremely careful compression of a cylinder gasket around the upper circumference of each cylinder cavity. This requirement of conventional engine designs normally requires the use of six head bolts circumferentially spaced around each corresponding cylinder cavity. By forming the cylinder head and a portion of the conventional block integrally, the conventional head bolt arrangement can be entirely eliminated in favor of connecting means such as connecting bolts 60 extending upwardly through each bearing cap 61, bearing saddle 62 and lower assembly 10 for threaded engagement with the upper assembly 12. As illustrated in FIG. 1, two such connecting bolts 60 may be employed for each bearing cap 61, thus requiring a total of only four connecting bolt bosses to be formed within upper assembly 12 in surrounding relationship with each cylinder cavity. Naturally each cylinder cavity will share a pair of such bolt receiving bosses with the adjacent cylinder cavity since each bearing saddle is interleaved with the cylinder cavities in plan view.

An alternative to the use of a single pair of connecting bolts would be to cast a threaded sleeve 63 within lower assembly 10 in alignment with the bolt receiving bores on each side of the bearing caps 61. Corresponding aligned bolt receiving bores (not illustrated) could then be formed entirely through upper assembly 12 to permit an upper connecting bolt (not illustrated) to be inserted downwardly through the upper assembly 12 for engagement with the threaded sleeve 63 and to receive a second, axially aligned connecting bolt upwardly through one bore in the bearing cap for threaded engagement with another portion of the same threaded sleeve.

Figure 2:
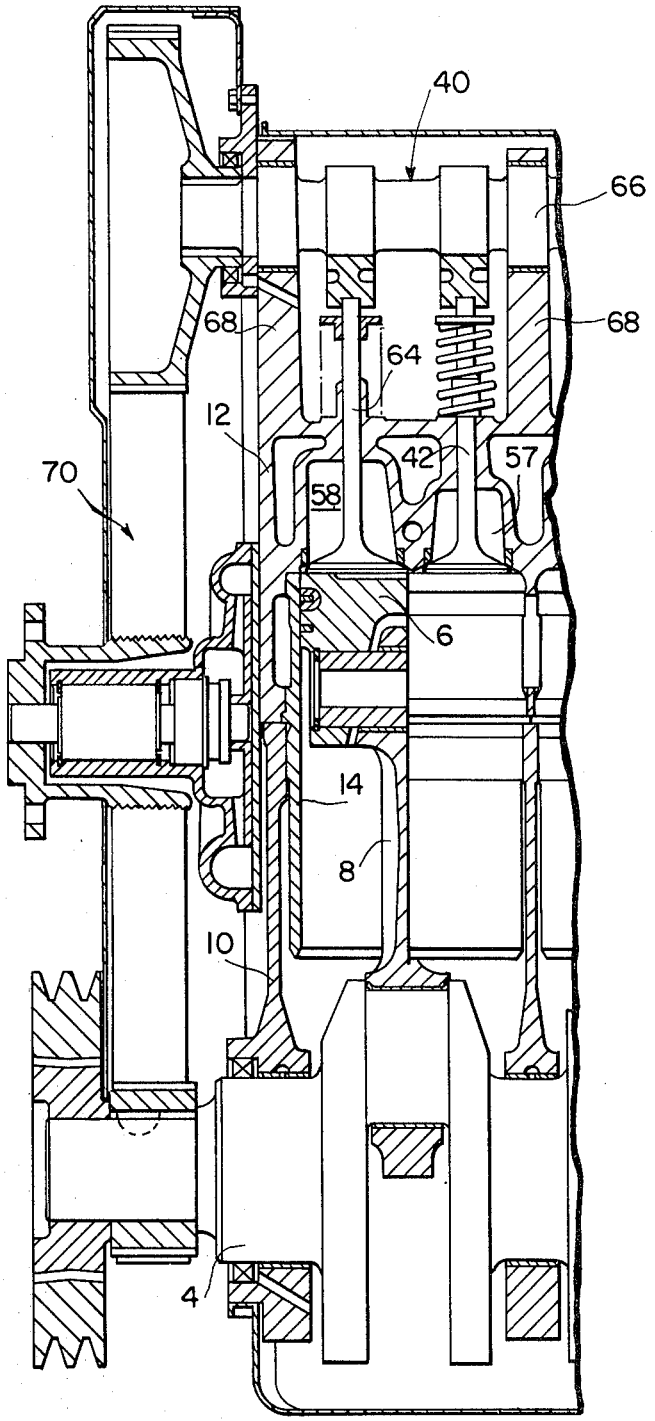
FIG. 2 is a partial cross-sectional view of the engine structural assembly of FIG. 1 taken along lines 2—2.

Turning now to FIG. 2, an engine structural assembly designed in accordance with the subject invention is illustrated in partial cross-sectional view taken along lines 2—2 of FIG. 1. Only one engine cylinder is illustrated in FIG. 2. However, the advantages of this invention may be employed in engine designs including 2, 4, 5, 6 or any desired number of cylinders. Those elements corresponding to the elements disclosed in FIG. 1 are identified by the same reference numerals. In addition to exhaust valve 42, inlet valve 64 is illustrated as being operated by overhead cam arrangement 40. As is clearly illustrated in FIG. 2, the overhead cam arrangement 40 includes a camshaft 66 rotationally mounted in upright struts 68. Camshaft 66 is driven in synchronism with crankshaft 4 by means of a drive train 70.

Figure 3A:
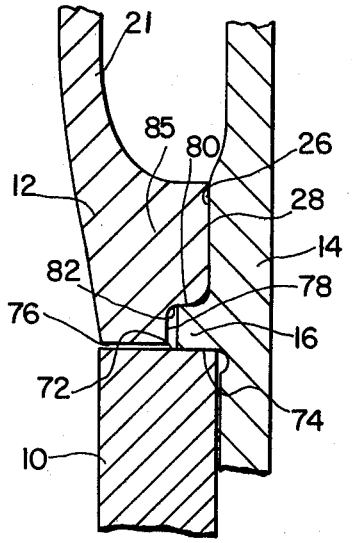
FIG. 3*a* is an enlarged portion of the cross-sectional view of FIG. 1 in the area circumscribed by dashed lines 3—3 prior to the upper and lower cylinder section assemblies being secured together.
Figure 3B:
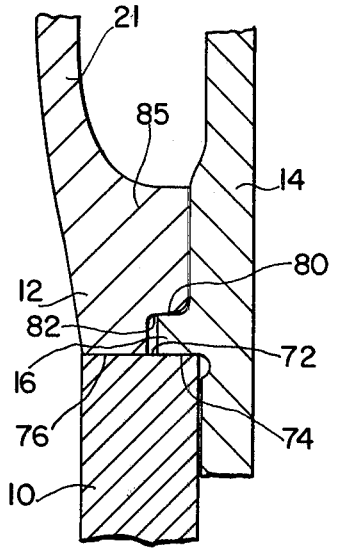
FIG. 3*b* is a cross-sectional view of the juncture of the upper and lower cylinder section assemblies as illustrated in FIG. 3*a* wherein the upper and lower assemblies have been brought into direct contact during assembly.

Turning now to FIGS. 3*a* and 3*b*, an enlarged partial cross-sectional view of the joint zone formed between lower assembly 10 and upper assembly 12 is illustrated. Lower assembly 10 includes an upper assembly engaging surface 72 positioned to engage the lower radial surface 74 of radial flange 16 to form a stop engaging means for engaging the radial flange 16 and for applying an upwardly directed force to the liner to form a gas tight seal between the upper end portion of the liner and the upper assembly 12. Surface 72 extends radially outwardly beyond the radial extent of flange 16 in order to provide a contacting surface for surface 76 of upper assembly 12. Surface 76 contains a recess 78 configured to receive radial flange 16 but has an axial depth less than the axial dimension of flange 16 as best illustrated in FIG. 3*a*. By this arrangement, surfaces 72 and 76 may be brought into contact by operation of connecting bolts 60 to thereby trap flange 16 between the upper and lower assemblies and axially lock liner 14 within the cylinder cavity. As noted above, the total axial length between the lower radial surface 74 of flange 16 and the uppermost edge of liner 14 may be formed to cause the uppermost edge of the liner to contact compressively wall 18 to form a metal to metal combustion gas seal. When an axial seal of this type is formed, the compliance of the axial portion of liner 14 between the liner stop and the uppermost end is relied upon to provide the axial seal pressure during assembly of the engine. Thus, the amount of compliance may be controlled to a limited degree by adjusting the axial position of the liner stop to any desired point within the portion of the cylinder cavity contained in lower assembly 10. The total contact area between the upper radial surface 80 of flange 16 and the corresponding radial surface 82 of recess 78 is smaller than the the contact area between the inner radial surface 74 of flange 16 and the upper surface 76 of lower assembly 10. The relative sizes of these contact areas is different in recognition of the difference in properties between the cast aluminum lower assembly 10 and the cast iron of which the upper assembly 12 and liner 14 are formed. The greater rigidity of cast iron enables a smaller contact area to serve adequately whereas the more compliant light weight material of which lower assembly 10 is formed requires a larger contact surface with radial flange 16.

Figure 4:
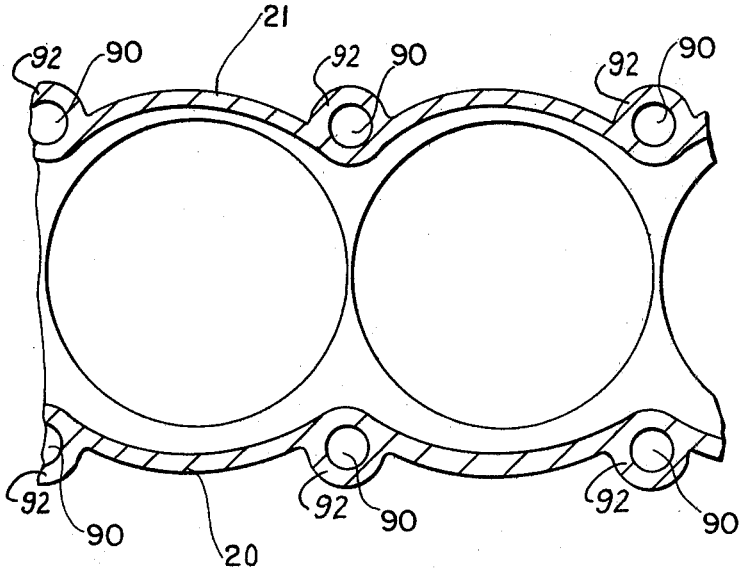
FIG. 4 is a partially cut away cross sectional view of the engine structure assembly taken along lines 4—4 of FIG. 1.

Reference is now made to FIG. 4 which is a partial cross sectional view of the upper assembly 12 taken along lines 4—4 of FIG. 1. FIG. 4 discloses one specific arrangement of the connecting means for attachment of the upper and lower assemblies wherein a pair of bores 90 are formed in bosses 92 between adjacent cylinder cavities for receiving connecting bolts (not illustrated) extending downwardly for threaded engagement with the lower assembly 10. As noted above, bores 90 may be aligned with corresponding bores in the bearing caps (FIG. 1).

Figure 5:
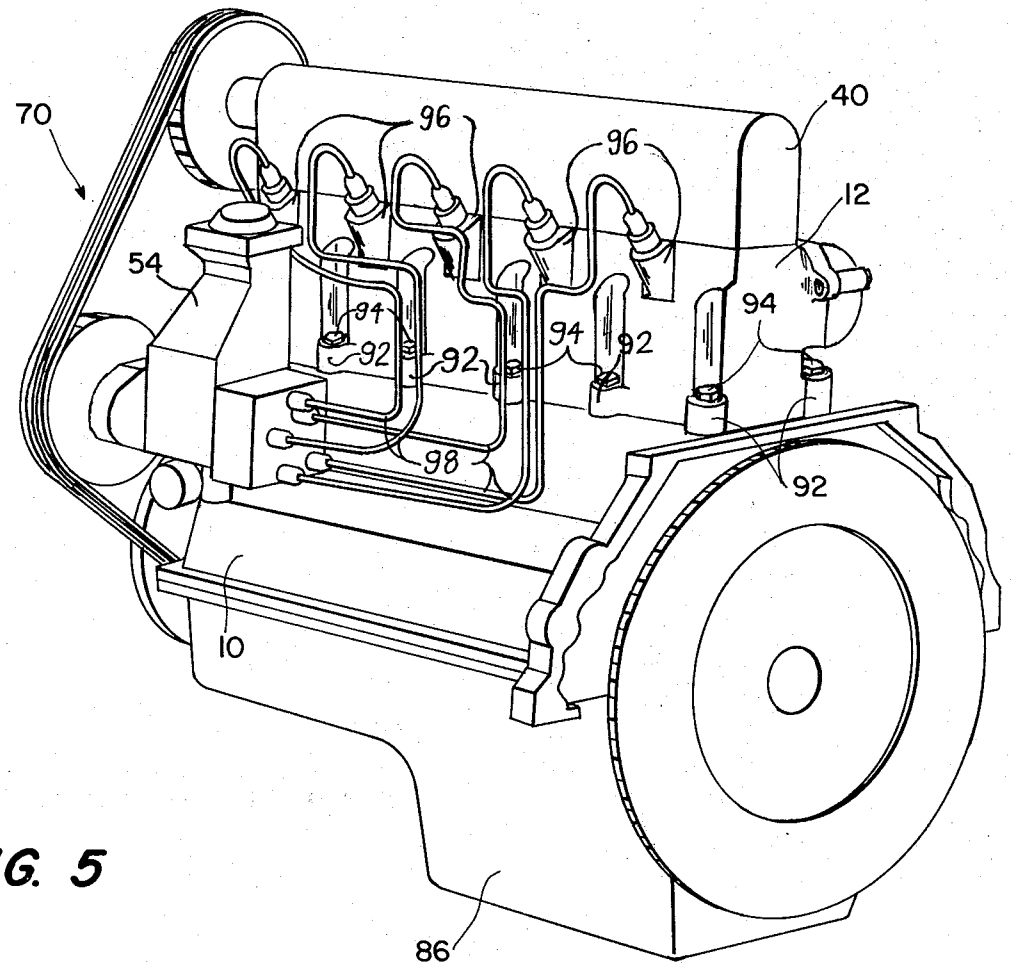
FIG. 5 is a perspective view of an overall engine structural assembly designed in accordance with the subject invention.

FIG. 5 is a perspective view of one embodiment of the subject engine design including lower assembly 10, upper assembly 12, oil pan 86 and drive train 70 for driving the cam arrangement 40 and the fuel pump 54. As is clearly illustrated in FIG. 5, a plurality of the connecting bolt bosses 92 may be formed integrally with upper assembly 12 for receiving connecting bolts 94 for downward threaded engagement with lower assembly 10. Bosses 92 contain bores 90 as illustrated in FIG. 4 for receiving connecting bolts 94. Auxiliary combustion chambers 96 function in a manner similar to the function of chamber 44 in FIG. 1 but each chamber 96 is oriented at a slant with respect to the vertical direction. Fuel from pump 54 is provided to each chamber 96 by fuel lines 98.

An extremely important functional result of the integral head and upper cylinder section assembly configuration of the subject invention is its ability to reduce noise generation during engine operation. In particular, it is well recognized that engine noise is generated in large part upon ignition of the compressed fuel/air mixture within the engine cylinder. The vibrational energy generated tends to propagate downwardly along the side walls of the engine into the crankcase and oil pan 86 (FIG. 1) which then operates as a resonator to cause vibrational energy within the audio range to be transmitted into the ambient environment. The position of the joint between the upper and lower assemblies has the effect of tending to damp the propagation of vibrational energy from the upper portion of each cylinder cavity downwardly into the lower assembly 10 and oil pan 86. Moreover, disposition of the liner midstop embodied in flange 16 adjacent the zone of joinder of the upper and lower assemblies has the effect of providing additional reenforcement to the portion of the block from which large amplitude vibrational energy would otherwise propagate downwardly. As is particularly well illustrated in FIGS. 3*a* and 3*b*, the portion of the upper block 12 located just above recess 78 is considerably thicker in the radial direction than is the remaining portion of side wall 20. This thickened area forms a band-like support 85 around the mid section of the liner. It is this thickened area which tends in part to reduce the amplitude of vibration which would otherwise propagate along the side wall of the engine block assembly into the engine oil pan.

Another important advantage of the joinder zone configuration illustrated in FIGS. 3*a* and 3*b* is the effect which this structure has on wet liner cavitation erosion. Previously it has been observed that the exterior surface of a wet liner will tend to erode over time. The subject invention reduces this phenomena for the following reasons. If the liner is subjected to vibrational movement, the well known phenomena of cavitation erosion occurs resulting in carbon atoms being extracted from the liner material. Over time this extraction of carbon atom leads to a breakdown in the structure of the material forming the liner. The subject engine and liner design significantly reduces cavitation erosion by concentrating support of the liner in the upper midsection where the greatest vibrational movement of the liner walls would otherwise be expected if the liner were unsupported in this region.

Another very important advantage of this invention derives from the short axial length of the coolant cavity 34. By this arrangement the weight and size of the upper assembly 12 is maintained at a minimum thereby facilitating assembly and maintenance of the engine. The short coolant cavity also reduces the required coolant system capacity thereby reducing weight, capital cost and energy losses which would otherwise be involved in providing and operating a larger size coolant system. By restricting the contact of coolant to only the upper 30% of the liner, the lower portion of the liner is allowed to attain a higher average operating temperature which causes a greater amount of usable energy to be retained in the exhaust gases of the engine. This characteristic of the invention is particularly important in the operation of a turbocharged engine where the exhaust gases are used to drive the engine turbocharger. Obviously, the more usable energy retained by the exhaust gases, the higher will be the engine efficiency.

Heretofore, it was not believed to be possible to restrict coolant contact to only the upper 30–40% of the liner in the mistaken belief that excessive temperatures would be attained. However, tests of the subject short coolant cavity design have proven that safe operating temperatures may be maintained despite the unconventionally short axial length of the coolant cavity.

INDUSTRIAL APPLICABILITY

An engine structural assembly has thus been disclosed which is characterized by high strength and efficiency as well as low weight and operational noise reducing capability. The subject design is particularly well suited to turbocharged compression ignition engines. This combination of desirable features results from the upper assembly being formed as an integral unit containing a cooling jacket which extends over a shorter portion of the wet linered cylinder cavity than has heretofore been thought to be necessary in order to supply sufficient cooling during engine operation. Because of the light weight, low noise generating characteristics, the disclosed engine is well suited for passenger type, over the road vehicles. The light weight, compact size and low noise generating characteristics of the subject engine design also make the disclosed engine ideal for other applications such as portable compression units, marine propulsion systems and other types of industrial applications in which portability and/or low noise operating characteristics are desired.

I claim:

1. An engine structural assembly for an internal combustion engine having a crankshaft, at least one reciprocating piston connected with the crankshaft and a cylinder cavity for receiving the reciprocating piston, said engine structural assembly comprising (a) liner means for guiding the reciprocating movement of the piston within the cylinder cavity, said liner means including a liner disposed within the cylinder cavity of the engine structural assembly, said liner including stop means intermediate the ends of said liner for retaining said liner in a desired axial position within the cylinder cavity, said stop means including a generally radial flange integral with said liner, said radial flange being positioned from the upper end of said liner by a distance which is less than 75 percent of the total axial distance of the lower limit of travel of the upper surface of the piston as measured from the end of said liner;

(b) an integral crankcase and lower cylinder section assembly containing that portion of the cylinder cavity which receives the lower portion of said liner extending downwardly from said radial flange toward the crankshaft when said liner is positioned within the engine structural assembly, said lower assembly includes a stop engaging means for engaging said radial flange and for applying a sealing force to said liner to form a gas tight seal between the upper end portion of said liner and said upper assembly; and (c) an integral head and upper cylinder section assembly containing a recess shaped to form that portion of the cylinder cavity which receives the upper portion of said liner extending upwardly from said radial flange away from the engine crankshaft when said liner is positioned within the engine structural assembly, said upper assembly including (1) a combustion chamber forming wall integral with said upper assembly extending across the upper end of said liner when said liner is positioned within the engine structural assembly, and (2) coolant cavity forming means for directing cooling fluid through the engine structural assembly along a coolant path shaped to bring the coolant into direct contact with the liner only along that portion of said liner extending above said stop means, wherein said stop engaging means includes an upper assembly engaging surface positioned to engage the lower radial surface of said radial flange, said upper assembly engaging surface extending radially outwardly beyond the radial extend of said radial flange, said upper assembly including a lower assembly engaging surface for contacting said radially outwardly extending portion of said upper assembly engaging surface.

2. An assembly as defined in claim 1, wherein said lower assembly engaging surface of said upper assembly is recessed to define a radial flange receiving recess having an axial depth less than the axial length of said radial flange.

3. An assembly as defined in claim 2, further including connecting means for fastening together said upper and lower assemblies with sufficient force to bring said upper and lower assembly engaging surfaces into direct contact.

4. An assembly as defined in claim 3, wherein said upper assembly includes first interference fit means for forming an interference fit between said upper assembly and the outer circumferential surface of said liner adjacent the upper end of said liner and second interference fit means for forming an interference fit between said upper assembly and the outer circumferential surface of said liner adjacent said radial flange and, wherein said liner receiving recess of said upper assembly includes a pair of side walls, said first interference fit means including a first annular circumferential surface having an undistorted diameter slightly less than the corresponding surface of said liner and said second interference fit means includes a second annular circumferential surface having an undistorted diameter slightly less than the corresponding surface of said liner.

5. An assembly as defined in claim 4, wherein said coolant cavity forming means includes a recess formed in said side walls between said first and second circumferential surfaces, the surface of said recess being spaced from the corresponding outer surface of said liner for at least a portion of the circumference of said liner to define a coolant flow cavity.

6. An assembly as defined in claim 3, wherein the axial length of said liner within said liner receiving recess of said upper assembly is slightly less than the axial length of said liner receiving recess to form a small clearance between the upper end surface of said liner and said combustion chamber forming wall.

7. An assembly as defined in claim 6, further including a combustion gas seal disposed within said small axial clearance between said upper end surface of said liner, said combustion gas seal having an uncompressed axial length greater than the axial length of said small clearance to cause said combustion gas seal to be compressed when said upper and lower assembly engaging surfaces are brought into contact by said connecting means.

8. An assembly as defined in claim 2, wherein said liner and said upper assembly is formed of cast iron and said lower assembly is formed of light metal alloy.

9. An assembly as defined in claim 8, wherein the contact area between the upper radial surface of said radial flange and the corresponding radial surface of said radial flange receiving recess is smaller than the contact area between the lower radial surface of said radial flange and said upper assembly engaging surface of said lower assembly.

10. An assembly as defined in claim 3, for use with an internal combustion engine having a plurality of reciprocating pistons connected with the engine crankshaft, and a plurality of aligned cylinder cavities for the reciprocating pistons, respectively, further including a corresponding plurality of said liners disposed within said cylinder cavities, respectively, said lower assembly including a plurality of crankshaft bearing saddles, said saddles being interleaved with said cylinder cavities in plan view, each said saddle including a pair of bolt receiving bores aligned generally parallel to the central axes of said aligned cylinder cavities and extending upwardly toward said upper assembly, a plurality of bore extensions formed in said upper assembly and coaxially aligned with corresponding bolt receiving bores in said lower assembly and a plurality of crankshaft bearing caps corresponding in number to the number of said crankshaft bearing saddles, each said bearing cap containing a pair of cap bores coaxially aligned with said bolt receiving bores in said lower assembly, and wherein said connecting means includes a plurality of connecting bolts disposed within said aligned bores, respectively.

11. An assembly as defined in claim 10, wherein said connecting means includes a threaded portion within each said bore extension for engaging a corresponding threaded portion of the corresponding connecting bolt.

12. An assembly as defined in claim 10, wherein said connecting means includes a hollow internally threaded insert mounted within each bolt receiving bore in said lower assembly, said connecting means further including a pair of connecting bolts for each aligned set of said bores, one connecting bolt of each pair passing downwardly through said upper assembly for threaded engagement with said threaded insert and the other bolt of each pair passing upwardly through said crankcase bearing cap into said lower assembly for threaded engagement with said threaded insert.

13. An assembly as defined in claim 3, wherein the axial distance between said first and second annular circumferential surfaces is less than 30 percent of the total axial length of said liner.

14. In an internal combustion engine having a crankshaft, at least one reciprocating piston connected with the crankshaft and a cylinder cavity within which the reciprocating piston moves between upper and lower limits of travel, the combination comprising (a) an integral head and upper cylinder section assembly containing a recess shaped to form a first portion of the cylinder cavity, said upper assembly being formed of cast iron;

(b) an integral crankcase and lower cylinder section assembly containing the remaining portion of the cylinder cavity, said lower assembly being formed of metallic material distinct from cast iron;

(c) connection means for connecting said upper and lower assemblies along a joinder zone;

(d) liner means disposed within said cylinder cavity portions for guiding the reciprocating movement of the piston within the cylinder cavity, said liner means including an exterior surface spaced from the interior surface of said upper assembly recess to form a coolant cavity shaped to bring coolant into direct contact with no more than 40 percent of the total axial length of said liner means;

(e) combustion gas seal means for sealing the upper end portion of said liner means to form a combustion chamber; and (f) coolant seal means disposed adjacent said joinder zone for forming a coolant cavity seal between said liner means and at least one of said upper and lower cylinder section assemblies to cause coolant to contact directly said liner means substantially only along the portion of the liner received within said upper cylinder section assembly.

15. Apparatus as defined in claim 14, wherein said coolant cavity is shaped to bring coolant into direct contact with no more than approximately 30 percent of the total axial length of said liner means.

16. Apparatus as defined in claim 14, wherein said joinder zone between said upper and lower assemblies is positioned from the upper axial end of said liner means by a distance which is less than 75 percent of the total axial distance of the lower limit of travel of the upper surface of the piston as measured from the upper axial end of said liner means.

17. An assembly as defined in claim 14, wherein said upper assembly includes an annular reinforcing band around said coolant means adjacent said joinder zone whereby noise propagation from said upper assembly to said lower assembly is damped and cavitation erosion of said liner means surface in contact with the engine coolant is reduced.

18. Apparatus as defined in claim 14, wherein said upper assembly contains an inlet passage for introducing air into the cylinder cavity and an exhaust passage for exhausting the products of combustion from the cylinder cavity and further including turbocharger means mounted on said upper assembly for receiving the products of combustion from said exhaust passage and for using a portion of the energy contained therein to increase the flow of air to the cylinder cavity through said inlet passage.

19. Apparatus as defined in claim 14, wherein said liner means includes stop means for retaining said liner means in a desired position within said cylinder cavity by engaging directly said integral crankcase and lower cylinder section assembly, said stop means including a generally radial flange, and said coolant seal means includes adjacent portions of said upper and lower assemblies shaped to compress said flange.

20. Apparatus as defined in claim 19, wherein said upper assembly contains a radial flange receiving recess having an axial depth less than the axial length of said radial flange.

21. Apparatus as defined in claim 20, wherein the contact area between the upper radial surface of said radial flange and the corresponding radial surface of said radial flange receiving recess is smaller than the contact area between the lower radial surface of said radial flange and said lower assembly.

* * * * *